US012516898B2

(12) United States Patent
Ader

(10) Patent No.: US 12,516,898 B2
(45) Date of Patent: Jan. 6, 2026

(54) FIREARM FOUR-BAR LINKAGE AND SLIDER-CRANK MECHANISMS AND RELATED TECHNIQUES

(71) Applicant: Henry RAC Holding Corp, Rice Lake, WI (US)

(72) Inventor: Geoffrey Louis Ader, Chetek, WI (US)

(73) Assignee: Henry RAC Holding Corp, Rice Lake, WI (US)

( * ) Notice: Subject to any disclaimer, the term of this patent is extended or adjusted under 35 U.S.C. 154(b) by 176 days.

(21) Appl. No.: 18/465,386

(22) Filed: Sep. 12, 2023

(65) Prior Publication Data

US 2024/0085128 A1 Mar. 14, 2024

Related U.S. Application Data

(60) Provisional application No. 63/406,055, filed on Sep. 13, 2022.

(51) Int. Cl.
*F41A 3/72* (2006.01)

(52) U.S. Cl.
CPC ..... *F41A 3/72* (2013.01)

(58) Field of Classification Search
CPC ..... F41A 3/72; F41C 7/06; F41C 3/04
See application file for complete search history.

(56) References Cited

U.S. PATENT DOCUMENTS 57,808 A * 9/1866 Winchester ..... F41A 9/18 42/21
854,771 A * 5/1907 Strasburg ..... F41C 7/06 42/21
864,940 A * 9/1907 Whittier ..... F41A 9/18 42/21
2,881,547 A * 4/1959 Butler ..... F41A 3/18 42/16
9,625,231 B1 * 4/2017 Hass ..... F41C 7/06
9,897,410 B1 * 2/2018 Tarip ..... F41C 7/06
2006/0080880 A1 * 4/2006 Taylor ..... F41C 7/06 42/16

(Continued)

OTHER PUBLICATIONS

International Search Report and Written Opinion mailed Jan. 22, 2024 for International Application No. PCT/US2023/032496.

*Primary Examiner* — Joshua E Freeman
(74) *Attorney, Agent, or Firm* — Wolf, Greenfield & Sacks, P.C.

(57) ABSTRACT

The techniques described herein relate to methods and apparatus for a multi-linkage mechanical system comprising: a four-bar linkage mechanism comprising: a first ground connected to other linkages via a first revolute grounded joint and a second revolute grounded joint; a first crank; a first coupler; and a first output; and a slider-crank mechanism comprising: a second ground connected to other linkages via the second revolute grounded joint and a prismatic joint; a second crank; a second coupler; and a second output, wherein the first output of the four-bar linkage mechanism is connected to and configured to drive the second crank of the slider-crank mechanism. The techniques described herein relate to methods and apparatus for a firearm comprising: a lever; a four-bar linkage mechanism; and a slider-crank mechanism, wherein the lever includes at least one linkage of the four-bar linkage mechanism.

20 Claims, 19 Drawing Sheets

(56) References Cited

U.S. PATENT DOCUMENTS

| | | | | |
|---|---|---|---|---|
| 2009/0241395 | A1* | 10/2009 | Barnett | F41A 3/12 42/16 |
| 2016/0040956 | A1* | 2/2016 | Giannelli | F41C 7/06 42/17 |
| 2017/0227318 | A1* | 8/2017 | Yaka | F41A 3/12 |
| 2021/0347039 | A1 | 11/2021 | Paine et al. | |
| 2023/0304755 | A1* | 9/2023 | Tusting | F41C 7/06 |
| 2024/0085132 | A1* | 3/2024 | Herring | F41A 3/66 |

* cited by examiner

FIREARM FOUR-BAR LINKAGE AND SLIDER-CRANK MECHANISMS AND RELATED TECHNIQUES

RELATED APPLICATION

This patent claims priority under 35 U.S.C. § 119(e) to U.S. Provisional Application No. 63/406,055, titled "FIREARM FOUR-BAR LINKAGE AND SLIDER-CRANK MECHANISMS AND RELATED TECHNIQUES," filed on Sep. 13, 2022, which is hereby incorporated by reference herein in its entirety.

TECHNICAL FIELD

The techniques described herein are generally related to linkage mechanisms, especially for a firearm.

BACKGROUND

Generally, a firearm is a device that is designed to expel a projectile (e.g., a bullet) through the barrel of the firearm upon activation of an explosive (e.g., gunpowder within a casing of a cartridge that also holds the bullet). Firearms often include a trigger configured to actuate a firing pin to strike a fuse (e.g., a primer) of the cartridge to ignite the explosive, which causes the projectile(s) (e.g., including a bullet) to be expelled through the barrel of the firearm. Such interaction of the firing pin to the fuse is often controlled by depressing the trigger.

SUMMARY OF INVENTION

Some embodiments relate to a multi-linkage mechanical system comprising: a four-bar linkage mechanism comprising: a first ground connected to other linkages via a first revolute grounded joint and a second revolute grounded joint; a first crank; a first coupler; and a first output; and a slider-crank mechanism comprising: a second ground connected to other linkages via the second revolute grounded joint and a prismatic joint; a second crank; a second coupler; and a second output, wherein the first output of the four-bar linkage mechanism is connected to and configured to drive the second crank of the slider-crank mechanism.

Some embodiments relate to a firearm comprising: a lever; a four-bar linkage mechanism; and a slider-crank mechanism, wherein the lever includes at least one linkage of the four-bar linkage mechanism.

There has thus been outlined, rather broadly, the features of the disclosed subject matter in order that the detailed description thereof that follows may be better understood, and in order that the present contribution to the art may be better appreciated. There are, of course, additional features of the disclosed subject matter that will be described hereinafter and that will form the subject matter of the claims appended hereto. It is to be understood that the phraseology and terminology employed herein are for the purpose of description and should not be regarded as limiting.

BRIEF DESCRIPTION OF FIGURES

Various objectives, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1A:
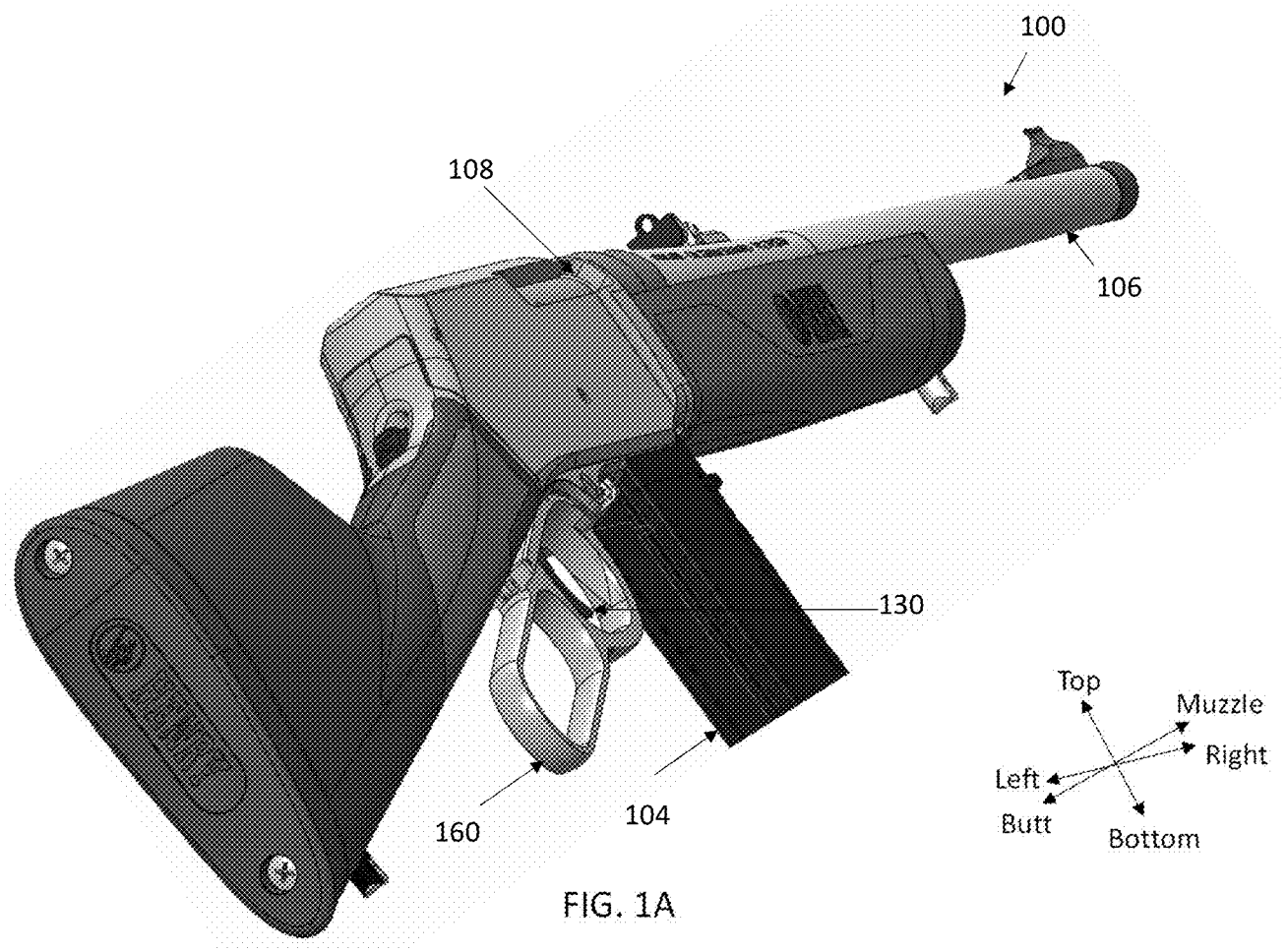
FIGS. 1A-1C are perspective diagrams of an exemplary lever-action firearm, according to some embodiments.

The techniques described herein provide for linkage mechanisms that are disposed within a firearm. The linkage mechanisms allow a firearm user to operate components of the firearm, such as the lever, bolt assembly, and/or bolt carrier group, via mechanical interactions of the mechanisms. For example, some firearms use bolt carrier groups in which the bolt carrier is the larger physical component and the bolt assembly is inserted into the bolt carrier. A bolt assembly assembled to a bolt carrier can be a bolt carrier group. Such a configuration can be used for firearms in which, for example, the bolt carrier group reciprocates to function the action, and, at the closed position, the bolt locks into the barrel assembly or the receiver. This will stay locked until some outside force (e.g., a linkage actuated by a lever, gas system, or a human hand) acts upon it (e.g., via the mechanism described herein). As shown and described herein, the bolt carrier group travels forward and backwards actuated by the linkages. In the forward position, the bolt can be forced to rotate via a helical cam slot. This rotated position puts the lugs of the bolt in front of lugs on the barrel assembly. As the explosion occurs in the chamber of the barrel when firing, the bolt is being pushed rearwards by the explosion. The bolt cannot travel rearwards because the lugs that are part of the barrel assembly are engaging with the lugs on the bolt. This can keep the user safe from the bolt traveling rearwards towards them at uncontrollable speeds as the explosion occurs inside the chamber of the barrel. Once the explosion is over, the user can open the lever, which causes the bolt to rotate to an angle where the lugs of the bolt can clear and travel past the lugs of the barrel assembly.

Some firearms, such as some lever actions, can use bolt assemblies but not a bolt carrier group. In some examples, similar to the bolt assemblies used in bolt carrier groups, bolt assemblies used on their own can contain an extractor and have a firing pin that will slide through it upon actuation. Mechanisms that contain no bolt carrier may have a wedge housed in the receiver, which is forced into and out of position by the lever into a notch in the bolt. When the wedge is in position, the bolt will stay locked in position, and not travel rearwards as the cartridge is fired. The bolt will only be able to travel rearwards when the user opens the lever, disengaging the wedge. This keeps the user safe from the bolt traveling rearwards towards them at uncontrollable speeds as the explosion occurs inside the chamber of the barrel.

The linkage mechanisms described herein include, for example, multi-bar linkages, slider-cranks, locking mechanisms, and other mechanisms that interact with the components used to operate the firearm (e.g., the lever, the bolt and bolt carrier, etc.). In some examples described herein, the techniques will be referred to as a linkage mechanism generally, without intending to be limiting.

The inventors have appreciated deficiencies with conventional mechanisms that are used to operate firearm components such as the lever, bolt, and bolt carrier. In particular, the inventors have appreciated that various types of firearms have mechanisms that could be safer, smoother, and/or longer lasting. For example, conventional mechanisms typically use and/or rely heavily on cam slots or paths, such as a cam path in the crank, a cam path in the lever, and so on. However, cam paths can create significant friction during use, and thus suffer from potential undesirable customer perception due to the challenge of working the action and/or wear over time. Accordingly, such mechanisms sometimes force the user to push or pull hard on the lever resulting in discomfort or even to replace parts.

Some conventional mechanisms are gear-driven, such as implementations where the firearm lever spins one or more gears within the firearm. However, like the use of cam slots or paths, gear-driven mechanisms can often provide undesirable customer perception and also wear over time, leading to problems such as skipping.

Some conventional firearms are configured such that the trigger travels with the trigger guard and/or the lever (e.g., as opposed to the trigger remaining attached to the firearm receiver). The trigger guard can, for example, be the portion of the lever that is in front of, below, and/or behind the exposed spur portion of the trigger. Not only are such configurations undesirable from an aesthetic standpoint, but such configurations can compromise the operation of the firearm. For example, such configurations can result in an undesirable loose/mushy trigger pull.

Some conventional firearms include mechanisms where, when the lever is actuated, the bolt carrier and/or other portions of the firearm extend backwards from the firearm. Similar to firearms where the trigger travels with the lever, such configurations can be undesirable, including for aesthetic, design and/or safety reasons.

The inventors recognized and appreciated that safer, smoother, longer lasting, and/or lower-cost linkage mechanisms can be achieved according to the techniques and embodiments described herein to provide for an improved lever action firearm. Techniques described herein can provide for the use of pivot or revolute joints instead of cam slots or cams for many components, including components related to the operation of the firearm lever. For example, using pivot joints in a linkages system can greatly reduce friction while providing a cost-efficient solution to some of the problems of conventional firearms, as described herein.

The techniques described herein address the above-described deficiencies of conventional firearms and others. The techniques provide for a linkage mechanism that includes a four-bar linkage mechanism and a slider-crank mechanism, wherein the rocker output of the four-bar linkage mechanism is connected to and configured to drive the crank of the slider-crank mechanism. In some embodiments, the four-bar linkage mechanism includes a ground link, a crank, a coupler, and the rocker output. In some embodiments, the slider-crank mechanism includes a ground sharing one of the four-bar linkage mechanism's revolute grounded joints, a crank, a coupler, and a slider output.

As will be described herein, linkage mechanisms can allow for the design of a lever action firearm with a solid back portion, such that the bolt carrier and/or other components can be entirely concealed within the firearm (e.g., rather than traveling beyond the back of the firearm when the lever is actuated), while keeping the lever out of the way of the magazine that is inserted within the firearm in front of the lever. Accordingly, the techniques described herein can allow the lever and magazine of a firearm to be disposed closer to each other without colliding than conventionally possible. The techniques described herein can further allow for keeping the trigger and trigger guard separate, such that the trigger can be mounted to the trigger housing and thus not travel with the lever when actuated.

The techniques described herein can be used to achieve improved bolt carrier operation. In some embodiments, the techniques described herein can allow for the bolt carrier or bolt to be accelerated during an actuation event of the lever that is at a constant angular velocity. (e.g., rather than moved at constant velocity). In some embodiments, the techniques described herein can allow the bolt carrier or bolt to be enclosed in the firearm, allow for linkages to operate as locking mechanisms, among other things. Accordingly, the firearm configurations achievable according to the techniques described herein can improve overall safety by concealing mechanical components entirely within the firearm. Doing so can allow, for example, for a mechanical safety to be disposed at the back portion of the firearm.

Techniques described herein can further allow for inexpensive stamping or diecasting to be used for the manufacturing of numerous components. For example, in some embodiments, the techniques can leverage components that are manufactured using diecasting. Such diecast components can include, for example, a diecast trigger housing. As an illustrative example, the linkages described herein can be configured for use with a trigger housing configured to accommodate the linkage components, where the trigger housing has a tongue-like portion extending in the middle of the trigger housing, with open cavities on the left and right of the tongue.

Accordingly, the linkage mechanisms described herein provide for a lever action firearm where the components all fit within the firearm and allow for smooth operation of the lever with a short throw such that the lever does not interfere with a magazine inserted within the firearm.

In the following description, numerous specific details are set forth regarding the systems and methods of the disclosed subject matter and the environment in which such systems and methods may operate, etc., in order to provide a thorough understanding of the disclosed subject matter. In addition, it will be understood that the examples provided below are exemplary, and that it is contemplated that there are other systems and methods that are within the scope of the disclosed subject matter.

Figure 1B:
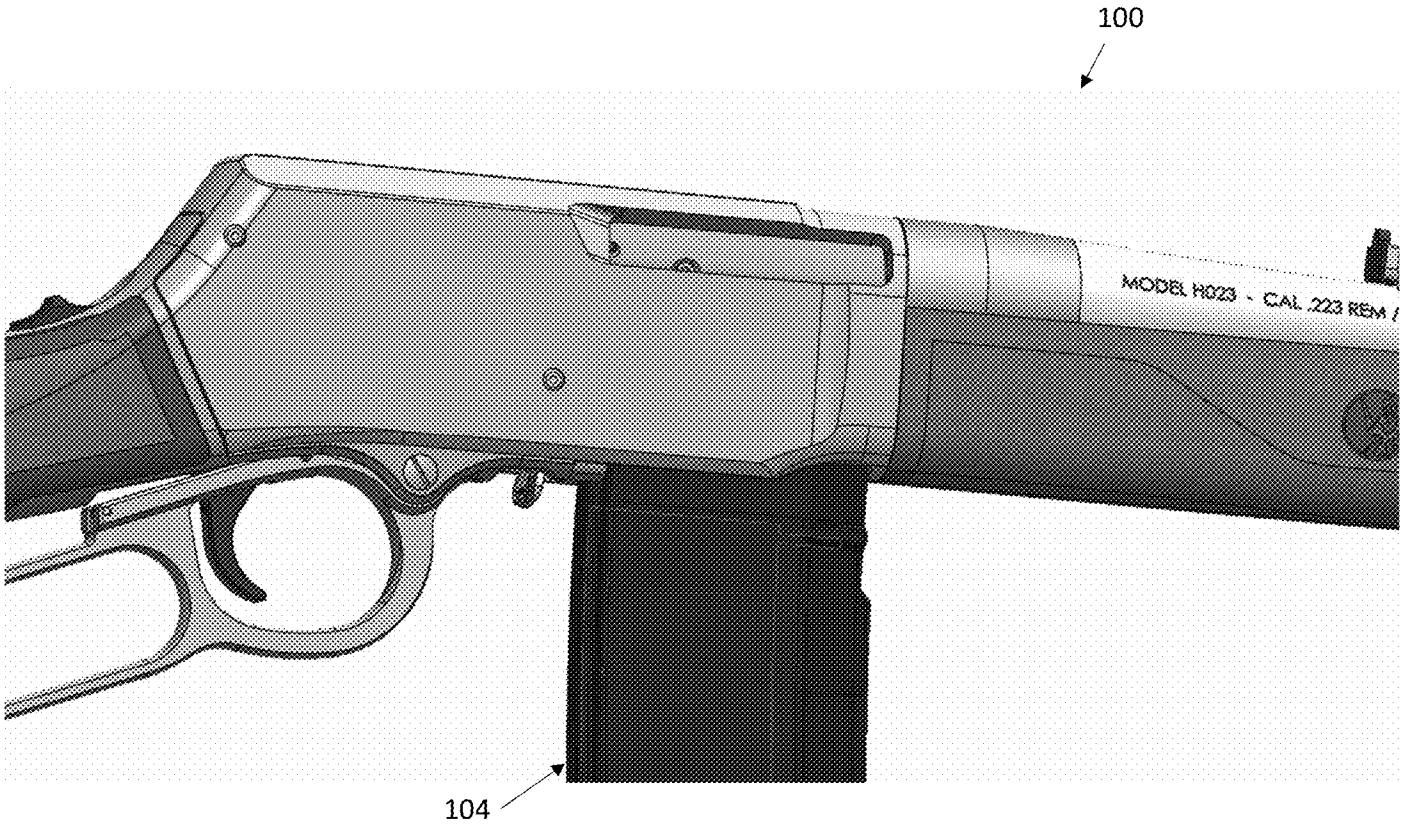
Figure 1C:
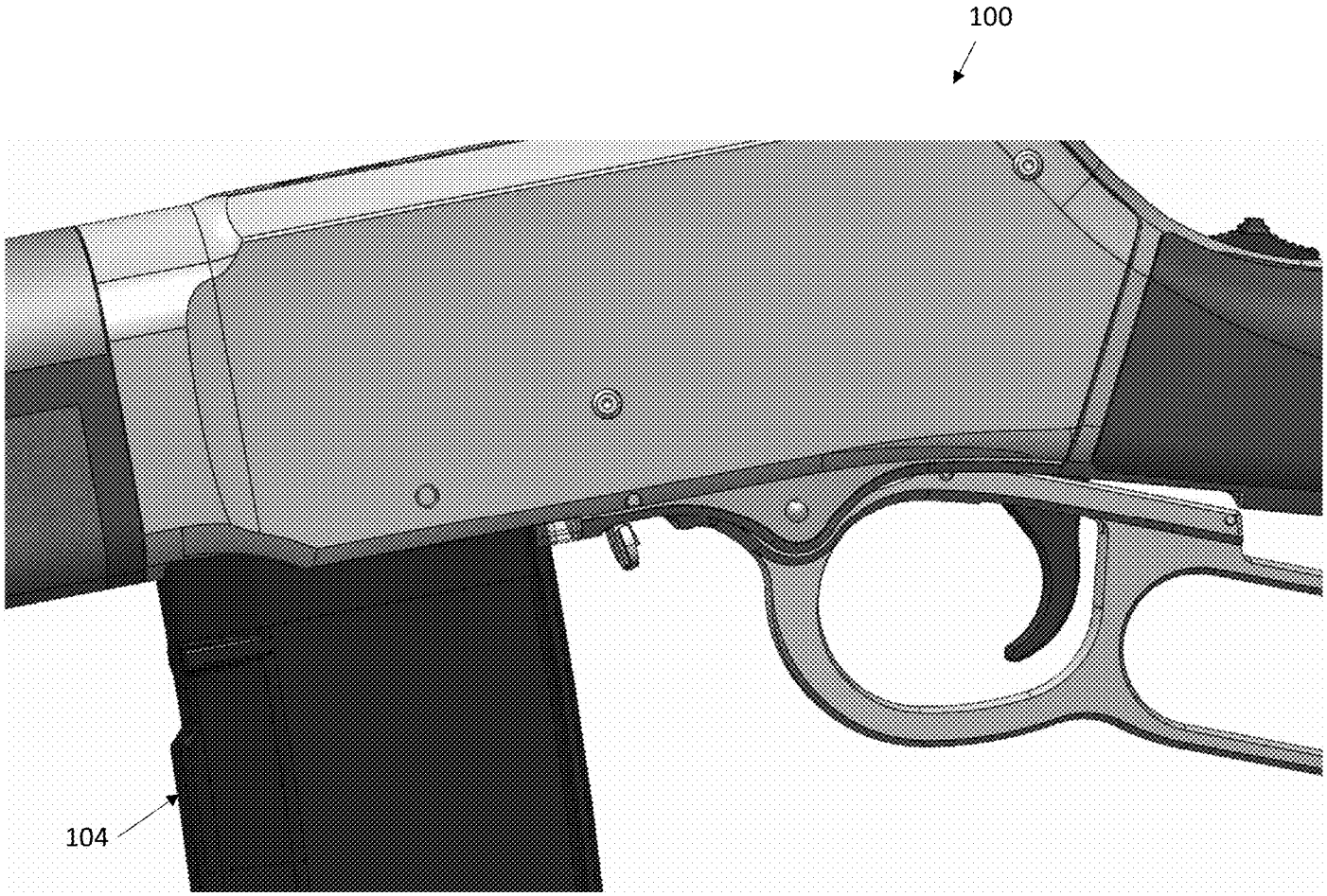

FIGS. 1A-1C are perspective diagrams of an exemplary firearm 100, according to some embodiments. The firearm 100 includes a magazine 104 that can be loaded into (and released from) the firearm 100. The magazine 104 is configured to hold a set (e.g., five, ten, fifteen, twenty, thirty, etc.) of cartridges (not shown) for use with the firearm 100.

Each cartridge includes a casing (or shell, such as in the case of a shotgun), a projectile(s) disposed at a proximal end of the casing (e.g., bullet, shot, slug, etc.), a fuse disposed at a distal end of the casing, and an explosive disposed within a portion of the casing between the fuse and the bullet.

The firearm 100 further includes a barrel 106 and a chamber 108 (not visible, internal to the barrel) disposed adjacent to the barrel and sized to receive a cartridge. In some embodiments, the firearm is a lever action firearm. For example, the firearm 100 may include a lever 160 that, when actuated by the user, loads a cartridge into the chamber 108 and/or unloads a cartridge from the chamber. The firearm 100 also includes a firing pin assembly or firing pin (not shown) that is mechanically actuatable by the trigger 130, such that upon actuation, the firing pin is configured to contact the fuse of the cartridge loaded into the chamber 108 to ignite the explosive and to cause the projectile(s) to be expelled through the barrel 106 of the firearm 100.

FIG. 2 is a plan view diagram of exemplary components of a linkage mechanism, according to some embodiments. In some embodiments, the mechanism is used in a firearm, such as a lever action firearm. FIG. 2 shows trigger 130, lever 160, axis 162, pin 163, pin 164, pin 165, pin 166, pin 167, bar A1 181, bar A2 182, bar A3 183, bar A4 184, bar B2 192, bar B3 193, bar B4 194, bolt carrier 195, and magazine 196.

In some embodiments, the multi-linkage mechanical system may include a four-bar linkage driving a slider-crank. For example, the multi-linkage mechanical system may comprise a four-bar linkage mechanism 180. In some embodiments, the four-bar linkage mechanism 180 may comprise a first ground 181, a first crank 182, a first coupler 183, and a first output 184 (which may comprise a rocker). In some embodiments, the first ground 181 may interact with other linkages via a first revolute grounded joint 162 and a second revolute grounded joint 165.

In some embodiments, the multi-linkage mechanical system may additionally comprise a slider-crank mechanism 190. In some embodiments, the slider-crank mechanism 190 may comprise a second ground that interacts with other linkages via the second revolute grounded joint 165 and a grounded prismatic joint 197, a second crank 192, a second coupler 193, and a second output 194 (which may comprise a slider). In some embodiments, the first output 184 of the four-bar linkage mechanism 180 is connected to and configured to drive the second crank 192 of the slider-crank mechanism 190.

In some embodiments, some or all of the bars of the multi-linkage mechanical system may include two main structural parts joined by one or more joining members. As a result, different components can move around and through each other depending on their relative openings and so on. For example, bar A1 181, bar A2 182, bar A3 183, bar A4 184, bar B2 192, bar B3 193, and/or bar B4 194 may each have two main structural parts both with the profiles shown in FIGS. 2 and 3, with one or more joining members connecting the two main structural parts. In some embodiments, at least some of the bars may have a single main structural part, such as the lever 160.

Figure 4A:
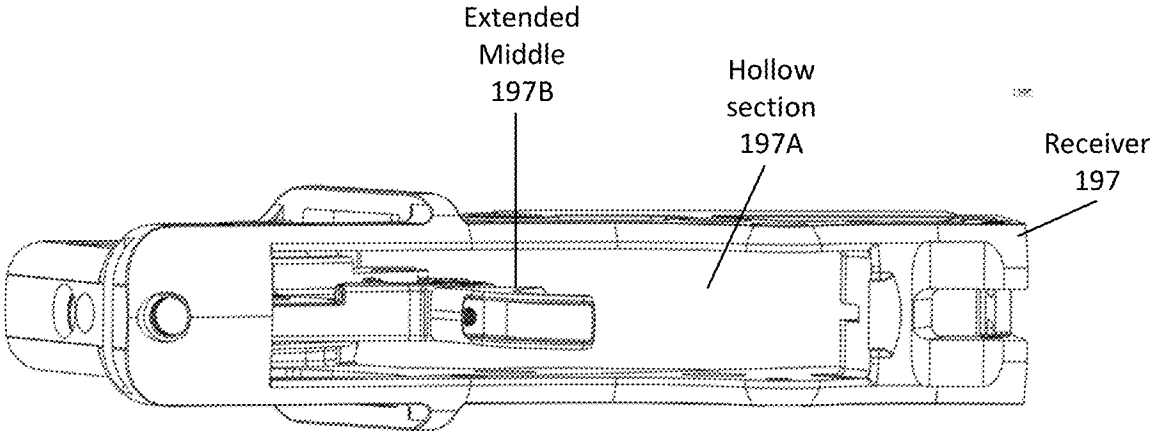
FIGS. 4A-4B show views of an exemplary receiver, according to some embodiments.
Figure 4B:
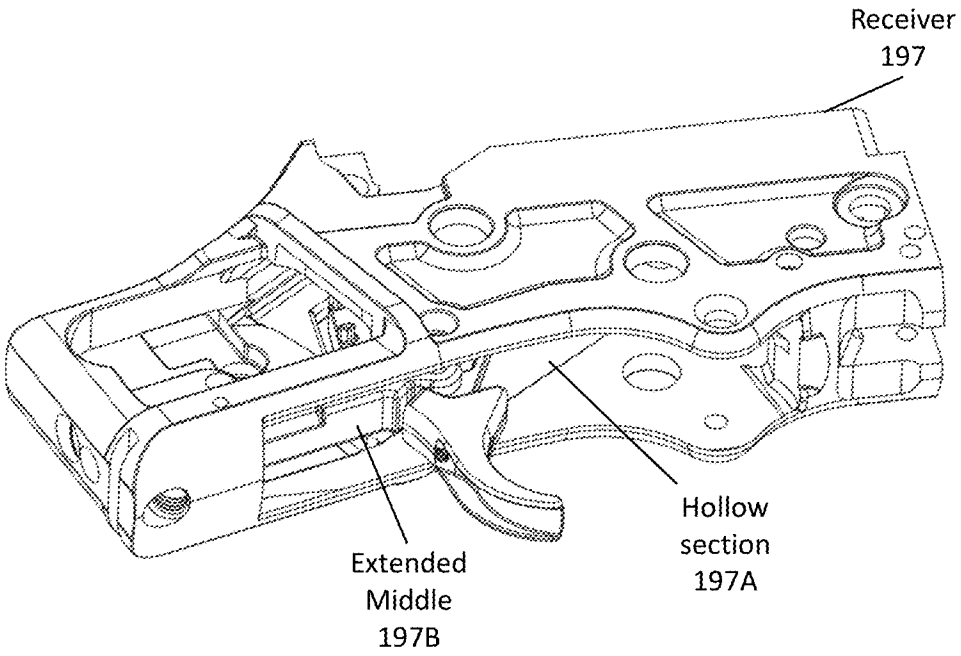
Figure 4C:
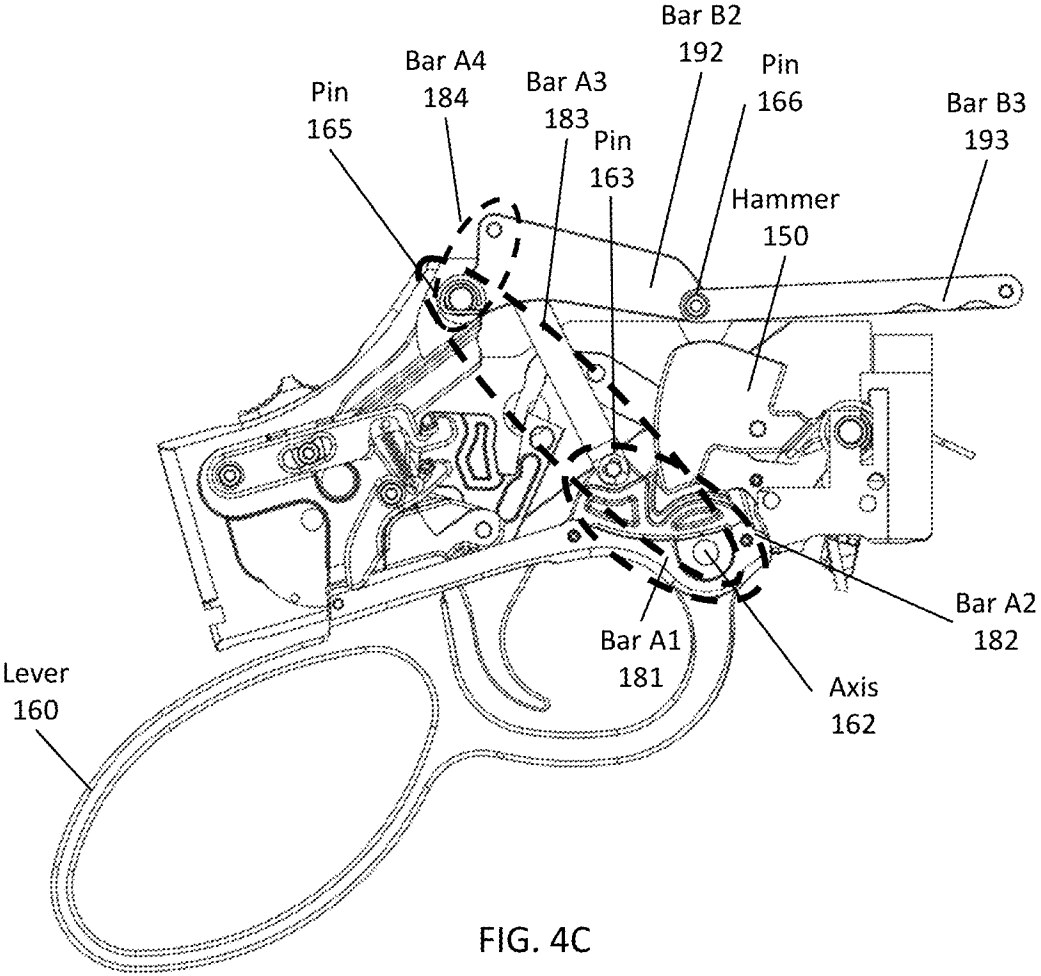
FIGS. 4C-4E show exemplary bar components with two main structural parts, according to some embodiments.
Figure 4D:
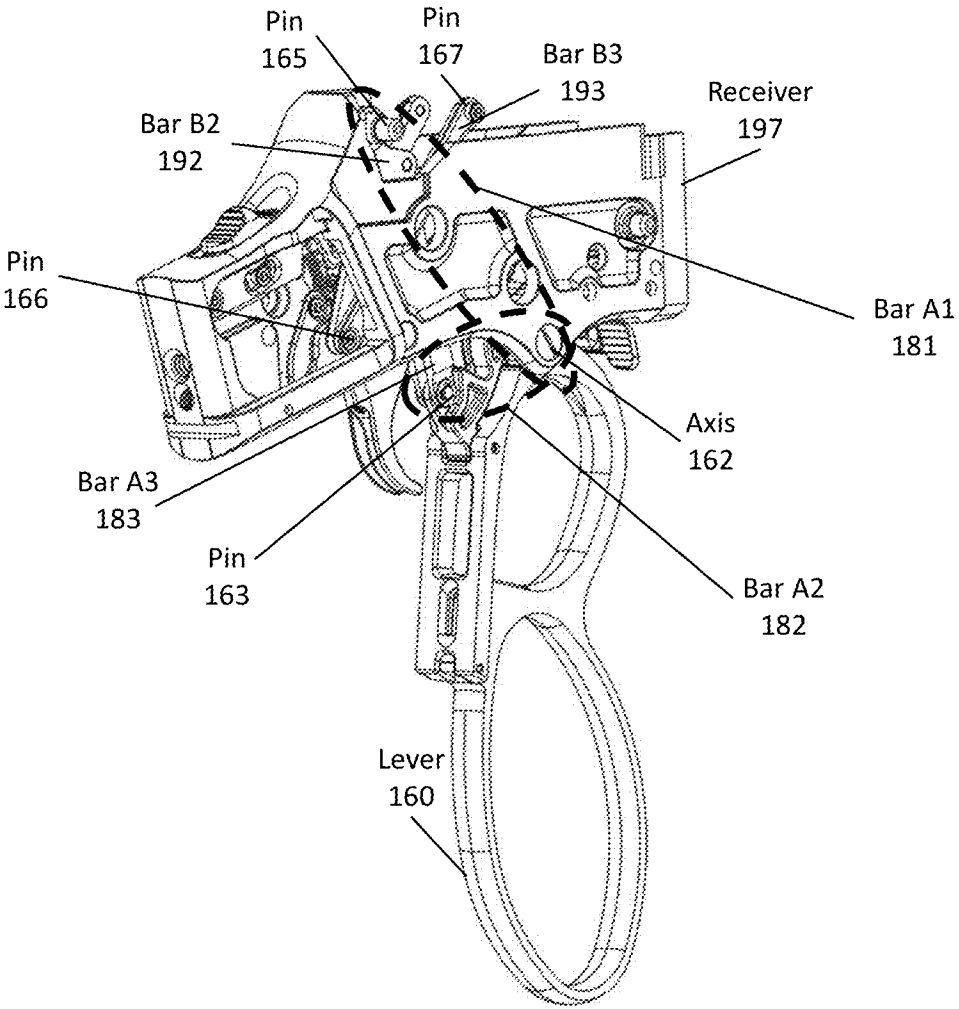
Figure 4E:
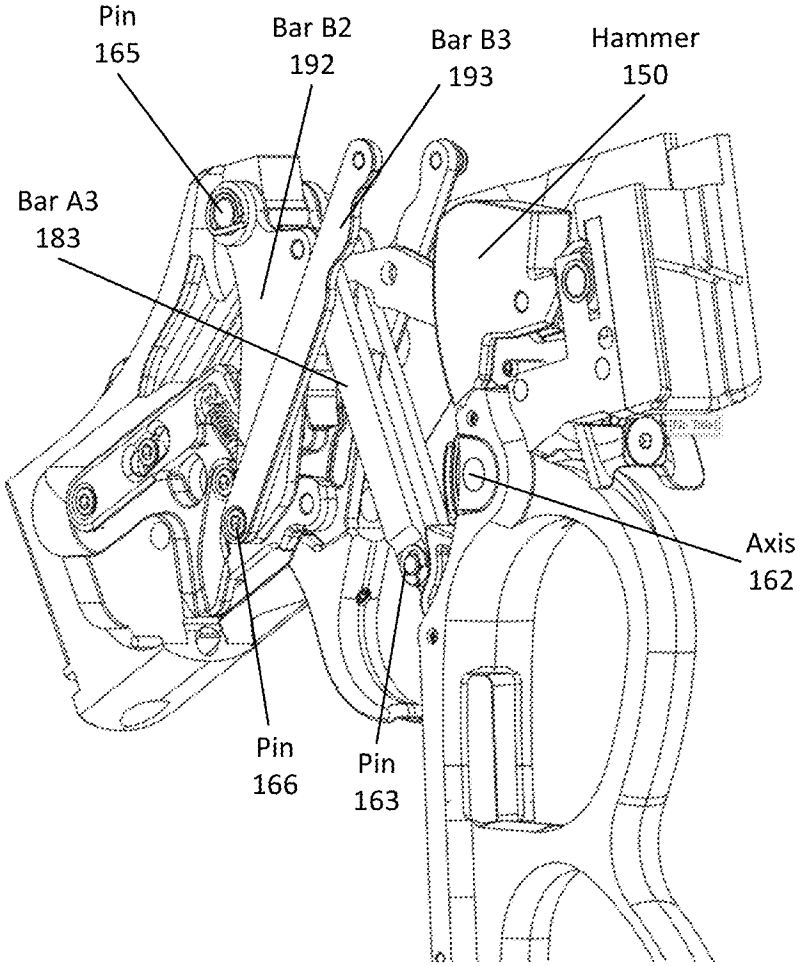

FIGS. 4A-4B show views of an examplary receiver 197, according to some embodiments. As shown without the other components, the receiver 197 includes a hollow section 197A and an extended middle section 197B. FIGS. 4C-4E add components and associated annotations to show how bar A1 181, bar A2 182, bar A3 183, bar A4 184, bar B2 192 and bar B3 193 may each have two main structural parts.

In some embodiments, the slider-crank may pivot under 360 degrees. For example, the second crank 192 may be configured to pivot less than 360 degrees around the second revolute grounded joint 165. The inventors have recognized and appreciated that the slider-crank may operate in some embodiments as a piston, while not being required to perform full rotations as a piston conventionally would.

In some embodiments, the slider-crank may pivot less than 180 degrees. For example, the second crank 192 may be configured to pivot less than 180 degrees around the second revolute grounded joint 165.

In some embodiments, at least one linkage may perform double duty, such as functioning as a linkage in both the four-bar linkage and the slider-crank. For example, the second crank 192 may include the first output (which may be a rocker) 184 as a single linkage, such as is shown in FIG. 2.

In some embodiments, at least one revolute joint may be shared between multiple linkages. For example, the first output 184 and the first ground 181 may share the second revolute grounded joint 165.

In some embodiments, the first crank 182 may comprise at least part of the lever 160 of a lever action firearm and may be connected to ground by the first revolute grounded joint 162. In some embodiments, the first crank 182 may form a portion of the trigger guard 131, which may be part of the lever 160.

Figure 2A:
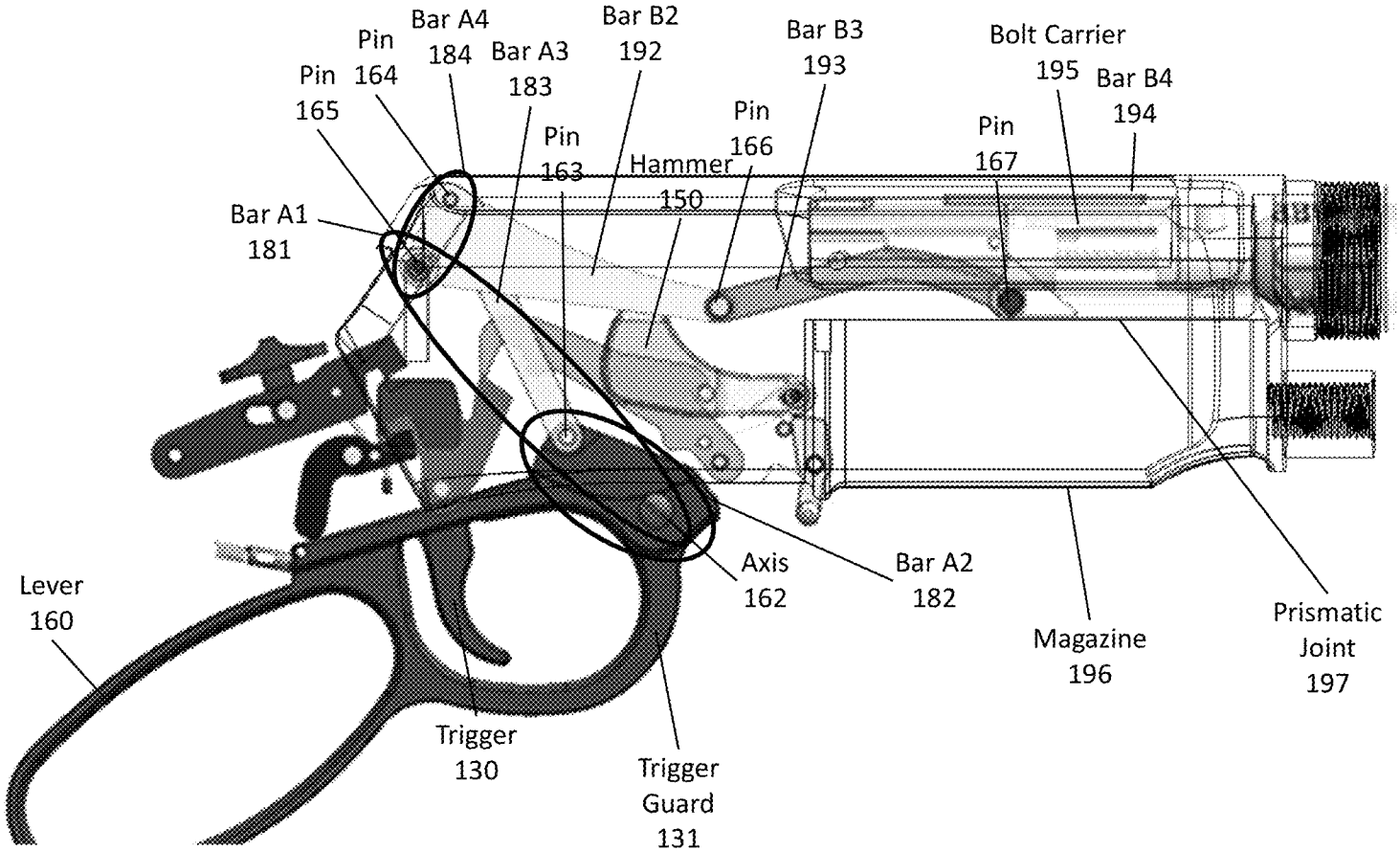
FIG. 2A is a plan view diagram of exemplary components of linkage mechanisms, according to some embodiments.
Figure 2B:
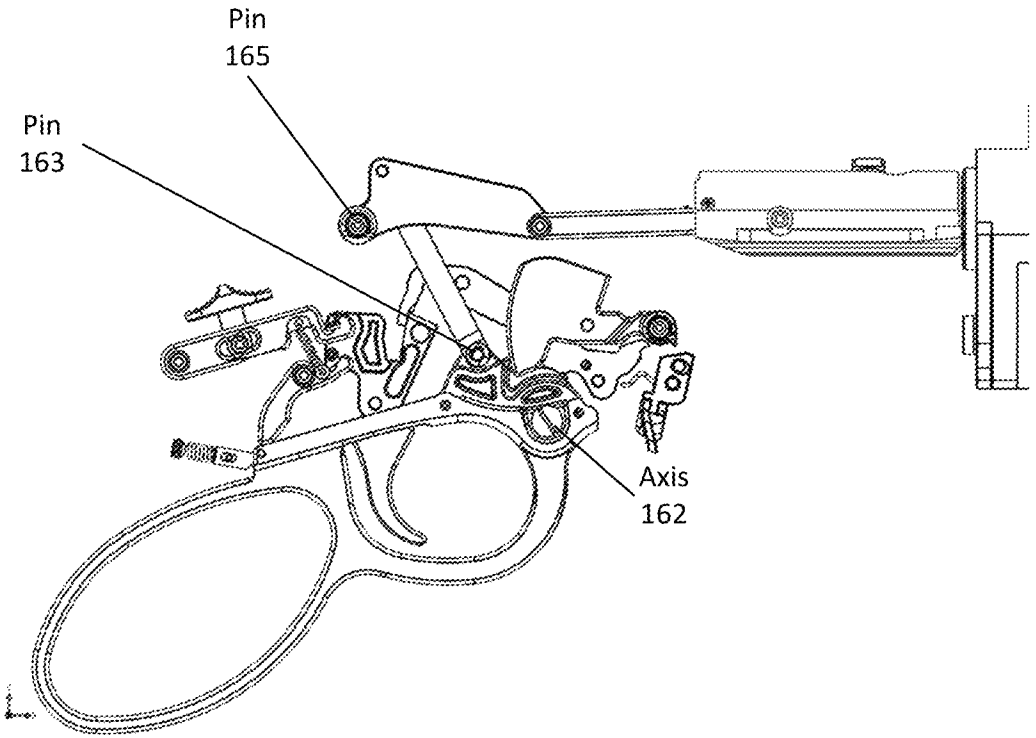
FIG. 2B is a further view of exemplary components of linkage mechanisms from FIG. 2A, according to some embodiments.
Figure 2C:
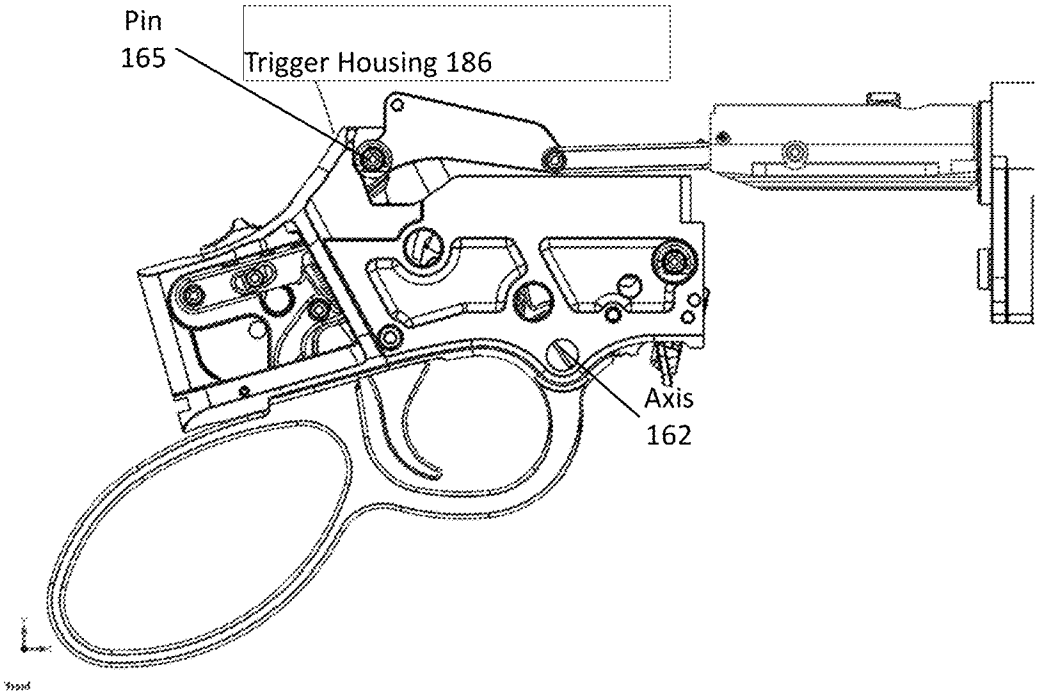
FIGS. 2C-2F shows the components of the linkage mechanisms with various portions of the trigger housing and other portions of the firearm, according to some embodiments.
Figure 2D:
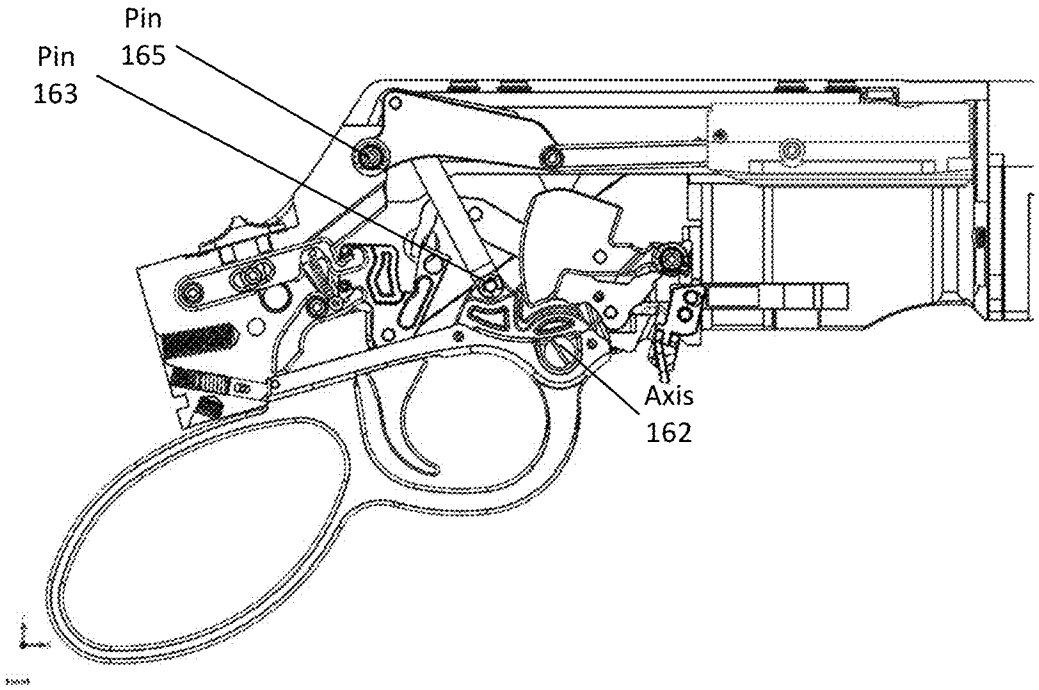
Figure 2E:
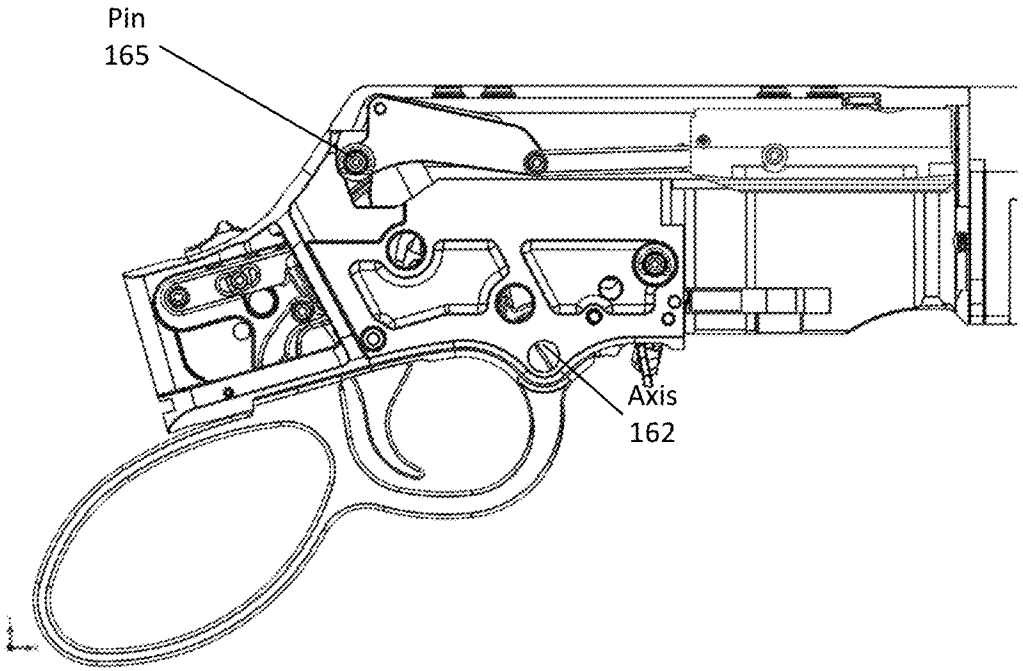
Figure 2F:
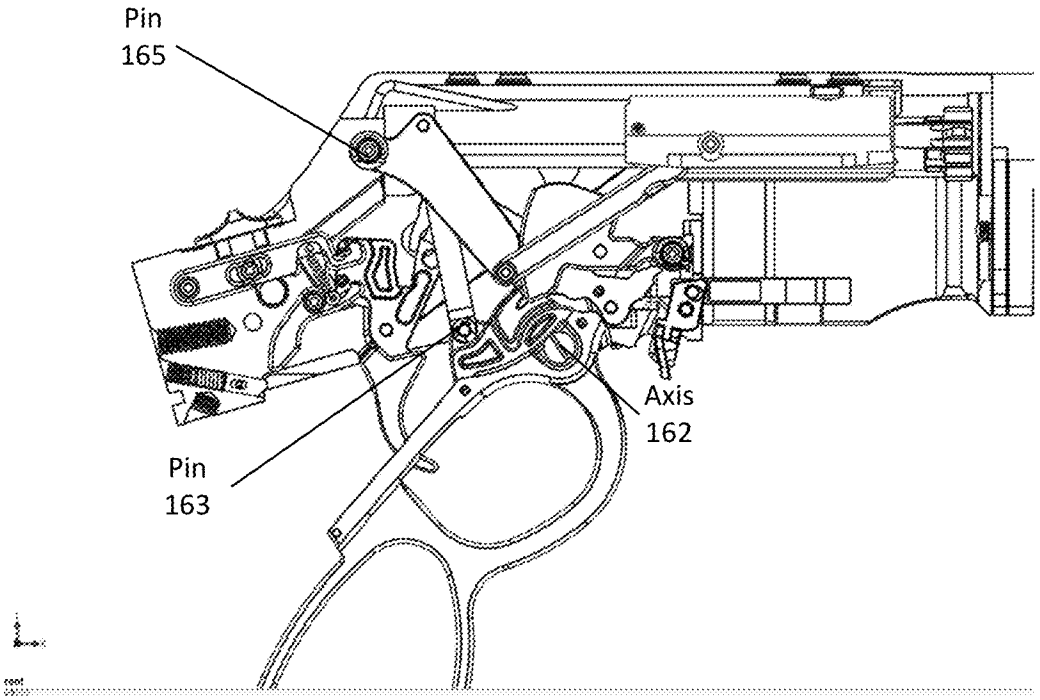
Figure 2G:
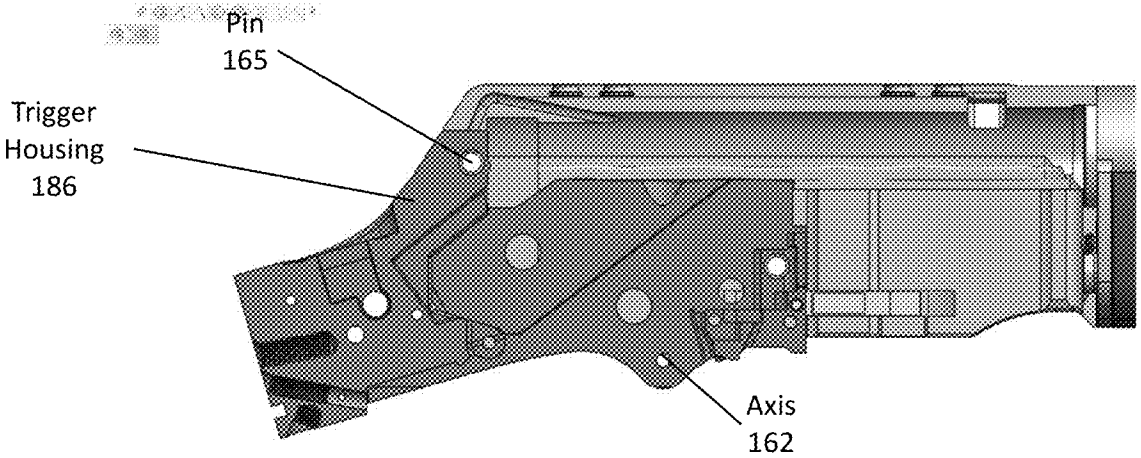
FIG. 2G shows the trigger housing, according to some embodiments.

In some embodiments, the first ground 181 may comprise a first structure (e.g., provided by the trigger housing 186) between the second revolute grounded joint 165 and the first revolute grounded joint 162. FIG. 2B shows components from FIG. 2A, without the trigger housing shown, according to some embodiments. FIG. 2C-2F shows the components with various portions of the trigger housing 186 and other portions of the firearm, according to some embodiments. FIG. 2G shows the trigger housing 186, according to some embodiments.

The inventors have recognized and appreciated that a trigger guard, especially one having this structure, may be difficult to manufacture conventionally, such as with metal machining. For example, the inventors have recognized and appreciated that trigger guards include small areas that are hard to reach with conventional metal machining. In some embodiments, the trigger guard is manufactured using die-casting, investment casting or other casting or molding methods.

As a result, in some embodiments the trigger 130 is able to be structurally separate from the lever 160. For example, FIGS. 1A-1C show an exemplary lever 160 with its integrated trigger guard 131 that is structurally separate from the trigger 130, as the lever 160 is partially rotated away from the trigger housing and receiver of the firearm while the trigger 130 has stayed with the trigger housing and receiver. The inventors have recognized and appreciated that keeping the trigger 130 and lever 160 separate may avoid a problem in some conventional firearms where the trigger travels with the lever, resulting in "mushy" trigger pull.

In some embodiments, the first crank 182 may comprise a second structure between the first revolute grounded joint 162 and a third revolute joint 163, which may be ungrounded. In some embodiments, the second structure may be part of the lever 160.

In some embodiments, the lever 160 may provide, and therefore be used to drive, the first crank 182, which may drive the first coupler 183. For example, pivoting of the lever 160 around the first revolute grounded joint 162 may be configured to drive the first crank 182 such that the first crank 182 drives the first coupler 183.

In some embodiments, the multi-linkage mechanical system may include a rocker and a slider. For example, the first output 184 may comprise a rocker and the second output 194 may comprise a slider.

In some embodiments, the second output 194 may comprise a bolt carrier or bolt 195 of a firearm. In some embodiments, the bolt carrier or bolt 195 may compress on or into or around itself, which may reduce its functional length by at least 10%. For example, the bolt carrier or bolt 195 may reduce its functional length by at least 15%, or at least 40%, or at least 50%. The inventors have recognized and appreciated that such a compression configuration may provide significant travel for the bolt carrier or bolt with much less travel of the lever, which makes the firearm more usable and more compact, as it allows the lever and magazine to be closer to each other without colliding. Moreover, such a compression configuration may provide acceleration to the bolt carrier or bolt rather than constant velocity. The inventors have recognized and appreciated that accelerating the bolt carrier or bolt rather than translating it at constant velocity can provide it with smoother travel during use, which can result in a better user experience. In particular, for example, being able to accelerate the bolt carrier gradually while maintaining a somewhat constant force and/or constant angular lever velocity allows the user to feel less discomfort while working the lever.

In some embodiments, the bolt carrier or bolt may be entirely internal to the firearm. For example, the bolt carrier or bolt may be enclosed by the structure of the firearm, as shown in FIGS. 1A-2. In some embodiments, the only portion of the bolt carrier or bolt exposed may be at the ejecting portal. The inventors have recognized and appreciated that enclosing so much of the bolt carrier or bolt may improve safety, especially in case of catastrophic failure, and may reduce liability risk for manufacturers, owners, and so on.

Figure 3:
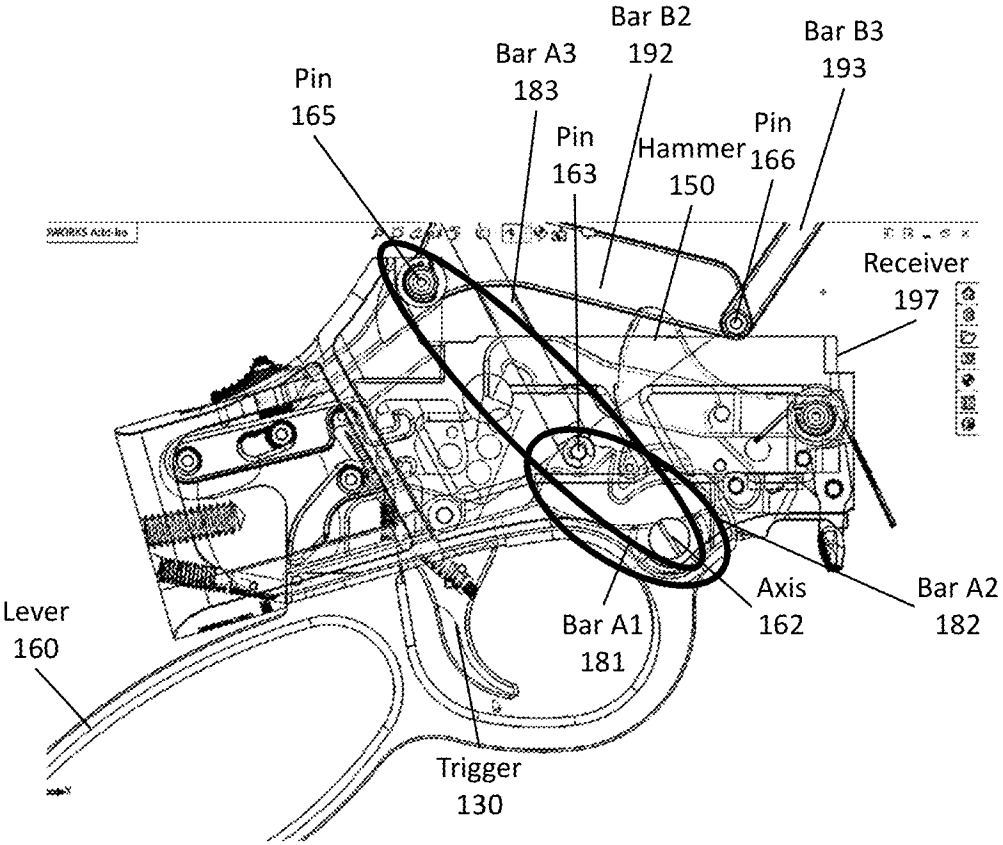
FIG. 3 is a plan view diagram of alternative exemplary components of linkage mechanisms, according to some embodiments.

In some embodiments, the hammer may be entirely internal to the firearm. For example, the hammer may be enclosed by the structure of the firearm, as shown in FIGS. 2-3 (e.g., hammer 150).

In some embodiments, both a four-bar linkage mechanism and a slider-crank mechanism may be used in the same device. For example, a firearm may include a lever 160, a four-bar linkage mechanism 180, and a slider-crank mechanism 190. In some embodiments, at least two of these three components may share structure. For example, the lever 160 may include at least one linkage of the four-bar linkage mechanism 180.

In some embodiments, the bolt carrier or bolt of the firearm may be cycled via pivot or revolute joints. For example, the four-bar linkage mechanism 180 and the slider-crank mechanism 190 may be configured to cycle a bolt carrier or bolt 195 of the firearm entirely via revolute joints, other than a prismatic joint between the bolt carrier or bolt 195 and ground (e.g., the receiver). The inventors have recognized and appreciated that such use of pivot or revolute joints may reduce or eliminate the use of cam slots or paths, at least in these particular components, thereby significantly reducing friction.

In some embodiments, the bolt or bolt carrier 195 may be cycled without the use of cam slots. For example, the four-bar linkage mechanism 180 and the slider-crank mechanism 190 may lack a cam slot. In some embodiments, the four-bar linkage mechanism 180 and the slider-crank mechanism 190 may lack a cam slot in the regions involved in cycling the bolt or bolt carrier 195. The inventors have recognized and appreciated that manufacturing and operating these mechanisms without cam slots or paths provide much more smoothness than conventional usage of cam slots, which introduce significant friction.

In some embodiments, the four-bar linkage mechanism 180 may include a bolt carrier or bolt 195. For example, the slider-crank mechanism 190 may itself comprise a slider 194, which may comprise the bolt carrier or bolt 195.

In some embodiments, the bolt carrier group or bolt assembly 195 is configured to collapse upon or over or into itself. For example, the bolt carrier or bolt 195 may collapse via telescoping or similar means. As a further example, the firing pin assembly (which can be part of the bolt carrier group or bolt assembly 195) may collapse.

In some embodiments, the four-bar linkage mechanism 180 may include a first ground 181 a first revolute grounded joint 162 and a second revolute grounded joint 165. In some embodiments, the four-bar linkage mechanism 180 may comprise a first crank 182, a first coupler 183, and a first output (e.g., a rocker) 184.

In some embodiments, the slider-crank mechanism 190 may comprise a second ground. For example, the second ground may include the second revolute grounded joint 165 and a prismatic joint. The slider crank mechanism may comprise of a second crank 192, a second coupler 193 and a second output (e.g., a slider) 194.

In some embodiments, one of the mechanisms may drive the other. For example, the four-bar linkage mechanism 180 may be configured to drive the slider crank mechanism 190. For example, the first output 184 of the four-bar linkage mechanism 180 may be connected to and configured to drive the second crank 192 of the slider-crank mechanism 190.

In some embodiments, the firearm may include a magazine 196 adjacent to the lever 160. For example, FIG. 2 shows an exemplary positional relationship between lever 160 and magazine 196.

Figure 5A:
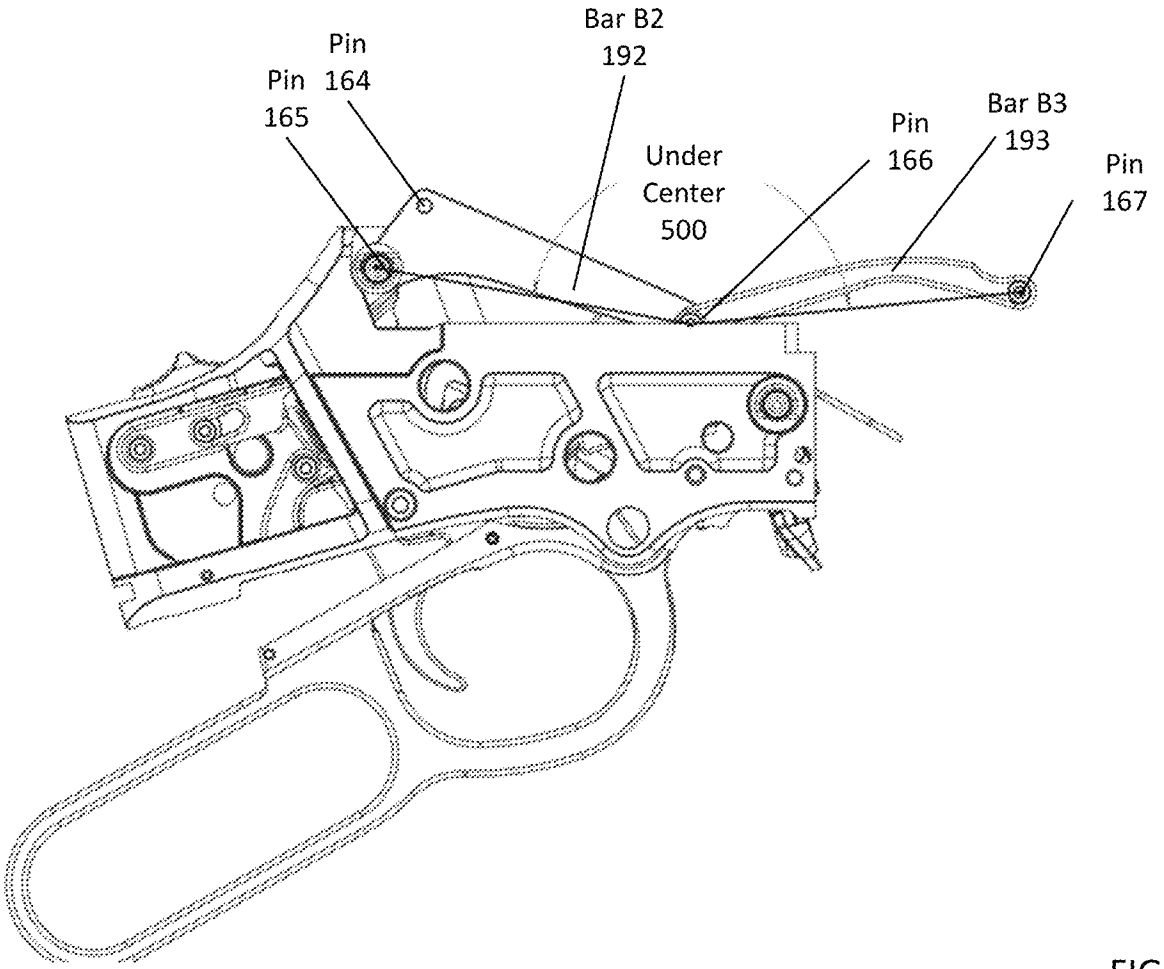
FIG. 5A shows the linkage mechanisms in an under center configuration, according to some embodiments.
Figure 5B:
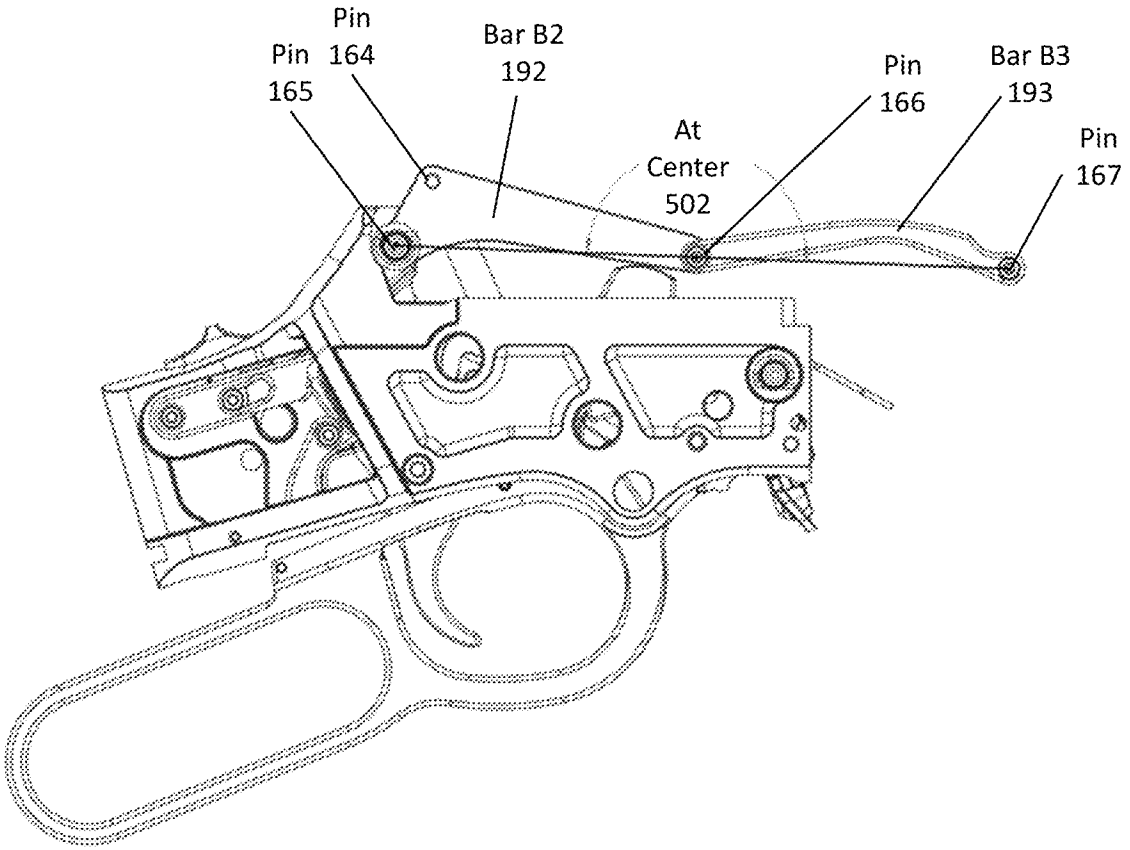
FIG. 5B shows the linkage mechanisms in an at center configuration, according to some embodiments.
Figure 5C:
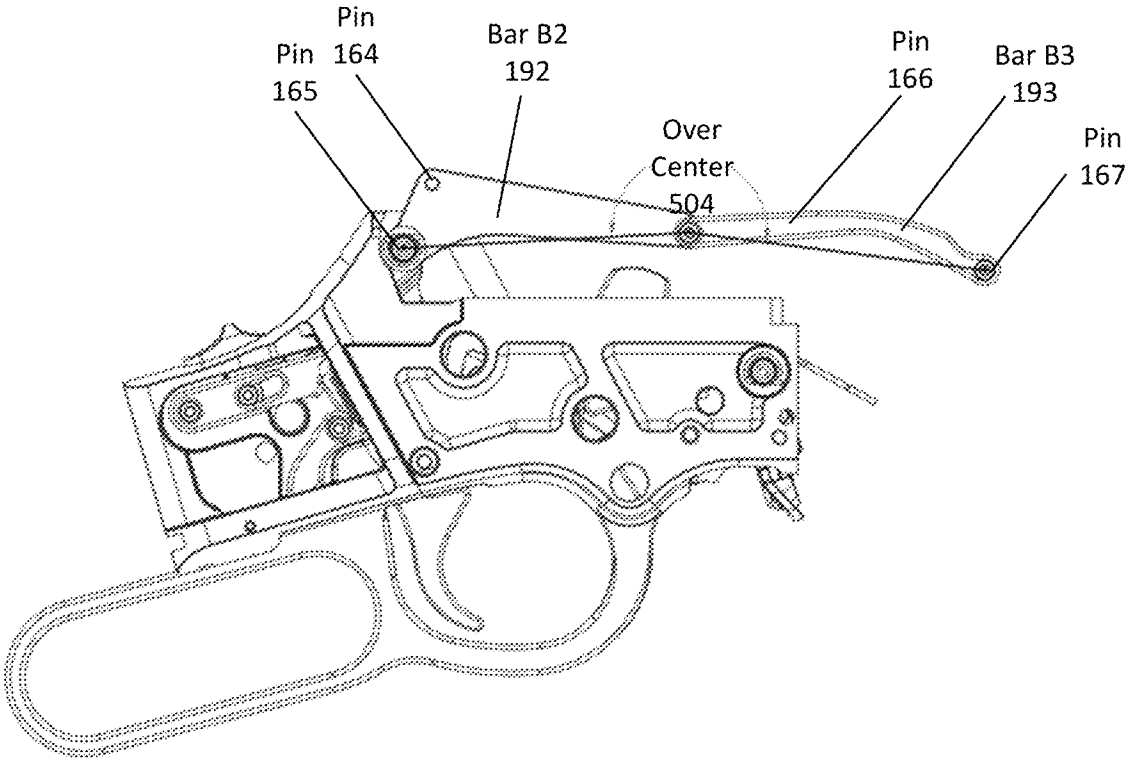
FIG. 5C shows the linkage mechanisms in an over center configuration, according to some embodiments.

In some embodiments, the firearm may lock via the four-bar linkage mechanism 180 and/or the slider-crank mechanism 190. In some embodiments, the four-bar linkage mechanism 180 and/or the slider-crank mechanism 190 may be configured such that motion of one or more parts directly or indirectly causes an action of the firearm to lock. In some embodiments, for example, as shown in FIGS. 5A-5C, the linkages can be used to provide a locking of the firearm action shunt (e.g., until the lever is actuated). FIG. 5A shows, for example, how the pin 166 joining bar B 192 and Bar B 193 is under center 500 from a line through pin 165 and pin 167, such that the pin 166 is below such a line. FIG. 5B shows how the pin 166 joining bar B 192 and Bar B 193 is at center 502 from a line through pin 165 and pin 167, such that pin 166 is at or near such a line. FIG. 5C shows how the pin 166 joining bar B 192 and Bar B 193 is over center 504, from a line through pin 165 and pin 167, such that pin 166 is above or over such a line. As a result, while the lever is being actuated, the firearm configuration is under or at center, and does not reach the above center configuration until the lever is fully closed. As a result, the firearm can be mechanically prevented from opening during firing via the linkages.

In some embodiments, the over-center configuration can be used to prevent opening of the bolt when firing. If the linkages are at an under center configuration, for example, the rearward force on the bolt can cause the linkages to buckle (e.g., which could open the lever since it is connected via bar B2 and Bar A3). When in an at center configuration, such a configuration could be sufficient to prevent opening of the bolt, as the configuration may not put any force on the lever to push it open via the linkage BAR A3 or to pull it closed. The force at center would transfer from the cartridge, through the bolt, linkages and into the trigger guard at the upper grounded joint. With the linkages in a (slightly) over center configuration, the forces from the cartridge would transfer to the bolt, and attempt to buckle the linkages at PIN 166 upwards instead of downwards. This would result the lever being pulled upwards via BAR A3. The lever cannot close any further since the trigger housing is in the way. As a result, such a configuration can be beneficial (e.g., including over an at center configuration) since it can ensure that the lever cannot open, and also that the bolt cannot travel rearwards when the explosion is occurring in the chamber.

In some embodiments, one or more of the linkages of the four-bar linkage mechanism 180 and/or the slider-crank mechanism 190 may be manufactured in whole or in part via stamping. The inventors have recognized and appreciated that using the configurations described in some embodiments herein may allow for such usage of stamping, which may significantly reduce manufacturing expenses as well as replacement complexity, especially versus highly specific cam slots or paths.

In some embodiments, the firearm is a lever action firearm.

It should be appreciated that while FIGS. 2-3 show exemplary configurations of linkage mechanisms, this is intended to be for illustrative purposes and not to be limiting. It should be appreciated that various other mechanical configurations and/or components can be used to achieve the techniques described herein.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the description provided herein be regarded as including such equivalent constructions insofar as they do not depart from the spirit and scope of the disclosed subject matter.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The word "exemplary" is used herein to mean serving as an example, instance, or illustration. Any embodiment, implementation, process, feature, etc. described herein as exemplary should therefore be understood to be an illustrative example and should not be understood to be a preferred or advantageous example unless otherwise indicated.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

Various aspects are described in this disclosure, which include, but are not limited to, the following aspects:

A1. A multi-linkage mechanical system comprising:
- a four-bar linkage mechanism [180] comprising:
  - a first ground [181] connected to other linkages via a first revolute grounded joint [162] and a second revolute grounded joint [165];
  - a first crank [182];
  - a first coupler [183]; and
  - a first output [rocker] [184]; and
- a slider-crank mechanism [190] comprising:
  - a second ground connected to other linkages via the second revolute grounded joint [165] and a prismatic joint [197];
  - a second crank [192];
  - a second coupler [193]; and
  - a second output [slider] [194],
- wherein the first output [184] of the four-bar linkage mechanism [180] is connected to and configured to drive the second crank [192] of the slider-crank mechanism [190].

A2. The multi-linkage mechanical system of A1, wherein the second crank [192] is configured to pivot less than 360 degrees around the second revolute grounded joint [165].

A3. The multi-linkage mechanical system of any of A1-A2, wherein the second crank [192] is configured to pivot less than 180 degrees around the second revolute grounded joint [165].

A4. The multi-linkage mechanical system of any of A1-A3, wherein the second crank [192] includes the first output [rocker] [184] as a single linkage.

A5. The multi-linkage mechanical system of any of A1-A4, wherein the first output (rocker) [184], and the first ground [181] share the second revolute grounded joint [165].

A6. The multi-linkage mechanical system of any of A1-A5, wherein the first crank [182] comprises at least part of a lever [160] of a lever action firearm and is connected to ground by the first revolute grounded joint [162].

A7. The multi-linkage mechanical system of any of A1-A6, wherein the first ground [182] comprises a first structure [trigger housing] [186] between the second revolute grounded joint [165] and the first revolute grounded joint [162].

A8. The multi-linkage mechanical system of any of A1-A7, wherein the first crank [182] comprises a second structure [part of 160] between the first revolute grounded joint [162] and a third revolute joint that is not grounded [163].

A9. The multi-linkage mechanical system of any of A1-A8, wherein pivoting of the lever [160] around the first revolute grounded joint [162] is configured to drive the first crank [182] such that the first crank [182] drives the first coupler [183].

A10. The multi-linkage mechanical system of any of A1-A9, wherein the first output [184] comprises a rocker and the second output [194] comprises a slider.

A11. The multi-linkage mechanical system of any of A1-A10, wherein the second output [194] comprises a bolt carrier or bolt [195] of a firearm.

B1. A firearm comprising:
a lever [160];
a four-bar linkage mechanism [180]; and
a slider-crank mechanism [190],
wherein the lever [160] includes at least one linkage of the four-bar linkage mechanism [180].

B2. The firearm of B1, wherein the four-bar linkage mechanism [180] and the slider-crank mechanism [190] are configured to cycle a bolt carrier or bolt of the firearm entirely via revolute joints other than a prismatic joint [167] between the bolt carrier or bolt [195] and ground.

B3. The firearm of any of B1-B2, wherein the four-bar linkage mechanism [180] and the slider-crank mechanism [190] lack a cam slot.

B4. The firearm of any of B1-B3, wherein the four-bar linkage mechanism [180] is configured to drive the slider crank mechanism [190].

B5. The firearm of any of B1-B4, further comprising a bolt carrier or bolt [195], wherein the slider-crank mechanism [190] comprises a slider [194] comprising the bolt carrier or bolt [195].

B6. The firearm of any of B1-B5, wherein the bolt carrier group or bolt assembly [195] is configured to collapse via telescoping or similar means.

B7. The firearm of any of B1-B6, wherein:
the four-bar linkage mechanism [180] comprises:
a first ground [181] connected to other linkages via a first revolute grounded joint [162] and a second revolute grounded joint [165];
a first crank [182];
a first coupler [183];
a first output [rocker] [184]; and
the slider-crank mechanism [190] comprises:
a second ground connected to other linkages via the second revolute grounded joint [165] and a prismatic joint [197];
a second crank [192];
a second coupler [193]; and
a second output [slider] [194], and
the first output [184] of the four-bar linkage mechanism [180] is connected to and configured to drive the second crank [192] of the slider-crank mechanism [190].

B8. The firearm of any of B1-B7, further comprising a magazine [196] adjacent to the lever [160].

B9. The firearm of any of B1-B8, wherein the firearm is configured to lock via the four-bar linkage mechanism [180] and/or the slider-crank mechanism [190].

B10. The firearm of any of B1-B9, wherein the four-bar linkage mechanism [180] and/or the slider-crank mechanism [190] is configured such that motion of one or more parts directly or indirectly causes an action of the firearm to lock.

B11. The firearm of any of B1-B10, wherein the firearm is a lever action firearm.

What is claimed is:

1. A multi-linkage mechanical system comprising:
a four-bar linkage mechanism comprising:
a first ground connected to other linkages via a first revolute grounded joint and a second revolute grounded joint;
a first crank;
a first coupler; and
a first output; and
a slider-crank mechanism comprising:
a second ground connected to other linkages via the second revolute grounded joint and a prismatic joint;
a second crank;
a second coupler; and
a second output,
wherein:
the first output of the four-bar linkage mechanism is connected to and configured to drive the second crank of the slider-crank mechanism, and
the first coupler and the first output are coupled via a revolute ungrounded joint.

2. The multi-linkage mechanical system of claim 1, wherein the second crank is configured to pivot less than 360 degrees around the second revolute grounded joint.

3. The multi-linkage mechanical system of claim 1, wherein the second crank is configured to pivot less than 180 degrees around the second revolute grounded joint.

4. The multi-linkage mechanical system of claim 1, wherein the second crank includes the first output as a single linkage.

5. The multi-linkage mechanical system of claim 1, wherein the first output and the first ground share the second revolute grounded joint.

6. The multi-linkage mechanical system of claim 1, wherein the first crank comprises at least part of a lever of a lever action firearm and is connected to the first ground by the first revolute grounded joint.

7. The multi-linkage mechanical system of claim 6, wherein pivoting of the lever around the first revolute grounded joint is configured to drive the first crank such that the first crank drives the first coupler.

8. The multi-linkage mechanical system of claim 1, wherein the first ground comprises a first structure between the second revolute grounded joint and the first revolute grounded joint.

9. The multi-linkage mechanical system of claim 1, wherein the first crank comprises a second structure between the first revolute grounded joint and a third revolute joint that is not grounded.

10. The multi-linkage mechanical system of claim 1, wherein:
the first output comprises a rocker and the second output comprises a slider; and
the second output comprises a bolt carrier or bolt of a firearm.

11. A firearm comprising a four-bar linkage mechanism and a slider-crank mechanism, the firearm further comprising:
a lever configured to rotate about a first revolute grounded joint;
a first bar coupled to the lever via a first revolute ungrounded joint;
a second bar configured to rotate about a second revolute grounded joint and coupled to the first bar by a second revolute ungrounded joint; and
a third bar coupled to the second bar by a third revolute ungrounded joint and coupled to a prismatic joint.

12. The firearm of claim 11, wherein the four-bar linkage mechanism and the slider-crank mechanism lack a cam slot.

13. The firearm of claim 11, wherein the prismatic joint comprises, or is coupled to, a bolt carrier or bolt.

14. The firearm of claim 13, wherein the bolt carrier or bolt is configured to collapse.

15. The firearm of claim 13, wherein the bolt carrier or bolt does not extend backward from the firearm when the lever rotates about the first revolute grounded joint.

16. The firearm of claim 11, further comprising a magazine adjacent to the lever.

17. The firearm of claim 11, wherein the firearm is configured to lock via the four-bar linkage mechanism and/or the slider-crank mechanism.

18. The firearm of claim 17, wherein:

when the lever is in a first position, the third revolute ungrounded joint is disposed above a line joining the second revolute grounded joint and the prismatic joint, and when the lever is in a second position, the third revolute ungrounded joint is disposed at or below the line joining the second revolute grounded joint and the prismatic joint.

19. The firearm of claim 11, wherein the four-bar linkage mechanism and the slider-crank mechanism lack a gear.

20. The firearm of claim 11, further comprising a trigger, and wherein the trigger does not travel with the lever when the lever rotates about the first revolute grounded joint.

* * * * *